US006945529B2

(12) United States Patent
Hagemann et al.

(10) Patent No.: US 6,945,529 B2
(45) Date of Patent: Sep. 20, 2005

(54) CONVEYING ARRANGEMENT FOR SHEET QUIRES AND METHOD FOR COMBINING SHEET QUIRES

(75) Inventors: Günther Hagemann, Hamburg (DE); Frank Herpel, Hamburg (DE); Jürgen Peter, Hamburg (DE)

(73) Assignee: E.C.H. Will GmbH, Hamburg (DE)

( * ) Notice: Subject to any disclaimer, the term of this patent is extended or adjusted under 35 U.S.C. 154(b) by 0 days.

(21) Appl. No.: 10/898,567

(22) Filed: Jul. 26, 2004

(65) Prior Publication Data

US 2005/0029733 A1 Feb. 10, 2005

Related U.S. Application Data

(62) Division of application No. 10/166,737, filed on Jun. 12, 2002.

(30) Foreign Application Priority Data

Jun. 15, 2001 (DE) ..... 101 28 653

(51) Int. Cl.[7] ..... B65H 29/68; B65H 31/00

(52) U.S. Cl. ..... 271/183; 271/270; 271/216; 271/208

(58) Field of Search ..... 271/183, 270, 271/216, 208

(56) References Cited

U.S. PATENT DOCUMENTS 4,092,021 A * 5/1978 Fletcher ..... 271/176
4,221,377 A * 9/1980 Bodewein et al. ..... 271/183
4,252,307 A * 2/1981 Korte ..... 271/4.01
4,436,302 A * 3/1984 Frye et al. ..... 271/202
5,957,050 A * 9/1999 Scheffer et al. ..... 101/227
6,591,748 B2 * 7/2003 Kerpe et al. ..... 101/232

FOREIGN PATENT DOCUMENTS

| | | | |
|---|---|---|---|
| DE | 1 245 702 | 7/1967 | |
| DE | 2 100 980 | 11/1973 | |
| DE | 30 10 284 | 9/1981 | |
| DE | 35 08 514 | 9/1986 | |
| DE | 34 09 548 | 12/1992 | |
| EP | 0 869 094 | 10/1998 | |
| EP | 0 900 757 | 3/1999 | |
| JP | 1-176-745 | * 7/1989 | ..... B65H/5/00 |

* cited by examiner

*Primary Examiner*—Donald P. Walsh
*Assistant Examiner*—Kenneth W. Bower
(74) *Attorney, Agent, or Firm*—Venable LLP; Catherine M. Voorhees

(57) ABSTRACT

A conveying arrangement for sheet quires includes successively arranged conveying devices of which a downstream conveying device as seen in a conveying direction has a lower speed than an upstream conveying device and at least one ionization device for electrostatic charging of the sheet quires. The downstream conveying device includes a suction device for administering suction air to the sheet quires at stationary suction openings.

13 Claims, 5 Drawing Sheets

CONVEYING ARRANGEMENT FOR SHEET QUIRES AND METHOD FOR COMBINING SHEET QUIRES

CROSS-REFERENCE TO RELATED APPLICATION

This application is a divisional of application Ser. No. 10/166,737, filed Jun. 12, 2002, and claims the priority of German Patent Application No. 101 28 653.8 filed in Germany on Jun. 15, 2001. The disclosure of the above applications and the disclosures of each and every U.S. and foreign patent and patent application mentioned herein, are incorporated herein by reference.

BACKGROUND OF THE INVENTION

The invention relates to an arrangement for conveying sheet quires, in particular supplied to at least one gathering area. Such an arrangement comprises at least two successively arranged conveying devices, wherein the front conveying device, in the conveying direction, has a lower speed than the one in the rear. The arrangement also includes at least one ionization device for the electrostatic charging of the sheet quires. The invention furthermore relates a method for joining the sheet quires.

Conveying arrangements of the above type are used to supply a continuous flow of sheets or sheet quires that may arrive from a cross cutter to a gathering area. Conveying arrangements of this type operate at a relatively high speed. Given such high speeds, it is difficult to deposit the sheet quires in a gathering area without damaging them. The speed of the sheets or sheet quires must be reduced drastically for the depositing, since an orderly deposit of the sheet quires is otherwise not possible. Until now, several production stages were successively connected to reduce the speed in case of high speed differences, which involved considerable structural expenditure.

A conveying arrangement or a conveying device of this type is disclosed in German Patent No. 2 100 980, in which the sheets and at least one of the conveying belts can be charged electrostatically with an ionization device to permit an electrostatic braking of the sheets. Ionization devices are preferably arranged for this purpose on both sides of the cut sheets that are conveyed along, thus permitting a controlled movement of the sheets to one of the gathering areas.

An arrangement for conveying, overlapping and depositing sheets of paper or the like, for example ejected from cross cutters, with the aid of a conveying belt and an additional, slower-moving conveying belt that is connected downstream in the conveying direction in a lower position, is disclosed in published German Patent Application No. 1 245 702. For this arrangement, the individual sheets are held in place on the slow moving belt, the so-called deceleration belt, by means of suction air. However, an arrangement of this type cannot be used if several sheets are stacked one above the other, in so-called sheet quires or paper quires.

German Patent No. 34 09 548, owned by the Assignee of the present application, discloses an arrangement and a method for decelerating and overlapping paper sheets in paper-processing machines. With this arrangement, the individual sheets or sheet quires are slowed down with the aid of at least one braking roller. A machine or method of this type and an arrangement of this type, however, is less suitable for use with sensitive paper sheets and very high speeds, since it can result in damage to the sheets or sheet quires.

SUMMARY OF THE INVENTION

In contrast to the known methods and arrangements described above, it is an object of the present invention to provide a conveying arrangement which makes it possible to convey sheets that are cut from webs or sorted sheets at very high speed.

It is furthermore an object of the present invention to reduce the high conveying speed over a relatively short movement distance to a speed suitable for depositing and, in the process, prevent the sheets or sheet quires from being damaged.

The above and other objects are achieved according to the invention by the provision of a conveying arrangement for sheet quires including: at least two successively arranged conveying devices of which a front conveying device as seen in a conveying direction has a lower speed than a rear conveying device; and at least one ionization device for electrostatic charging of the sheet quires; wherein an area of the front conveying device includes a suction device for administering suction air to the sheet quires in at least one region of the sheet quires.

By combining an ionization device and a suction device, an advantage that cannot be and is not anticipated by a person skilled in the art can be realized. That is to say, sheet quires can be slowed down from an extremely high speed to a lower speed and can be overlapped at a relatively low expense, without damaging the sheet quires. Combining the ionization of the sheet quires, to thereby hold the sheets together by electrostatic charge in the respective sheet quire, with the use of a suction device for slowing down and attracting of the sheet quires on the whole, ensures success according to the invention.

The exemplary embodiment provides that the at least one region of the sheet quires, is arranged in the back area of the sheet quires, in particular near the edge of the respective individual sheet quire, as seen in the conveying direction. Thus, it is possible to convey long formats or long sheet quires in the slow conveying device, that is the front conveying device, with a slower speed than has been possible so far. Furthermore, it means a non-contacting deceleration of the sheet quires at the back edge, thus causing no damage to the front edge, not even with high paper web speeds or sheet quire speeds. In the process, the long format sections or sheet quires are no longer pushed into each other during the braking phase, as is usually the case with a front-edge braking of sheet quires due to the normally occurring mass inertia.

A particularly preferred embodiment is realized if the front conveying device is provided with suction openings. Providing suction openings in the front conveying device, and in particular the respective conveying belts, leads to a particularly simple structural design of the front conveying device according to the invention. The suction openings preferably extend through at least one conveying belt of the front conveying device. The at least one conveying belt in that case can also be referred to as a suction belt. For the purpose of this invention, it is preferable to use several conveying belts or suction belts (in this case three), arranged side-by-side.

A particularly effective deceleration or speed reduction to the speed of the front conveying belt or the front conveying device results if the suction device comprises at least one suction box with suction slots, which can be made to cooperate with the suction openings. If the suction openings are arranged with a predetermined, and in particular uniform, spacing relative to each other on the at least one conveying belt, a format-independent overlapping distance can be selected. The overlapping distance is thus preferably adaptable and depends on the spacing of the respective suction holes in the at least one conveying belt.

A particularly effective ionization or electrostatic charging of the sheet quires can be realized if the conveying device or at least one additional element is at least partially electrically conductive in the area of the ionization device. It is advantageous in that case if an electrically conductive element is provided, in particular one that is locally fixed.

In order to realize a preferred embodiment of the conveying arrangement according to the invention, a phase displacement between the at least two successively arranged conveying devices is provided in dependence on the speed of the conveying arrangement. The phase displacement in this case functions to compensate the mass inertia of the sheet quires with higher speeds of the conveying arrangement. It must be taken into consideration here that the higher the speed of the sheet quires, the farther the sheet quires slide over the corresponding suction holes before they are held securely against the respective conveying belt by the suction air. A linear connection advantageously exists between the phase displacement and the speed of the conveying arrangement. Furthermore, the higher the speed of the conveying arrangement, the higher the lead of the front conveying device phase over the rear conveying device phase.

According to the invention, a paper-processing machine is provided with at least one of the aforementioned conveying arrangements. A paper-processing machine of this type processes in particular paper, but also so-called tissue paper. In particular, a paper-processing machine of this type is also used to cut, stack and package paper or tissue paper.

The objects of the invention are furthermore achieved by a method for combining sheet quires, comprising the steps of: electrostatic charging of the sheet quires; conveying the charged sheet quires to an overlap region, in which sheet quires that are arranged successively in the conveying direction are made to overlap; admitting the back ends of the sheet quires to be overlapped in the conveying direction with suction air, so that these can reach a speed approximating the conveying speed of previously overlapped sheet quires.

The operational steps according to the invention make it possible to combine and in particular to overlap the sheets on a slower conveying belt or deceleration belt, without slipping of the individual sheets in the sheet quires. An extremely fast and careful process guidance is possible in that case. Furthermore, the speed difference between the fed-in sheet quires and the overlapping sheet quires can be adjusted to be noticeably higher. Thus, the overlapping sheet quires have a slower speed when hitting the frontal end stop of a gathering box for a corresponding paper-processing machine, which results in a less damaging impact. Owing to the slower impact with the frontal end stop, the sheet quires to be overlapped are then carefully gathered into a stack of sheets, preferably following the aforementioned operational steps.

The process guidance can be highly secure if suction air is supplied with a phase displacement that depends on the conveying speed, relative to the moment at which the sheet quires are transported to the overlap region. A high degree of overlapping can be created if the phase displacement is such that the faster the sheet quires are conveyed, the earlier the suction air is supplied, particularly in a first conveying device.

BRIEF DESCRIPTION OF THE DRAWINGS

The invention is described in the following without restricting the general inventive idea and with the aid of exemplary embodiments by referring to the drawings, wherein explicit reference is made to the drawings for all inventive details not explained further in the text.

DETAILED DESCRIPTION OF THE INVENTION

In the following figures, the same elements are provided with the same reference numbers, so that these will not be presented again.

Figure 1:
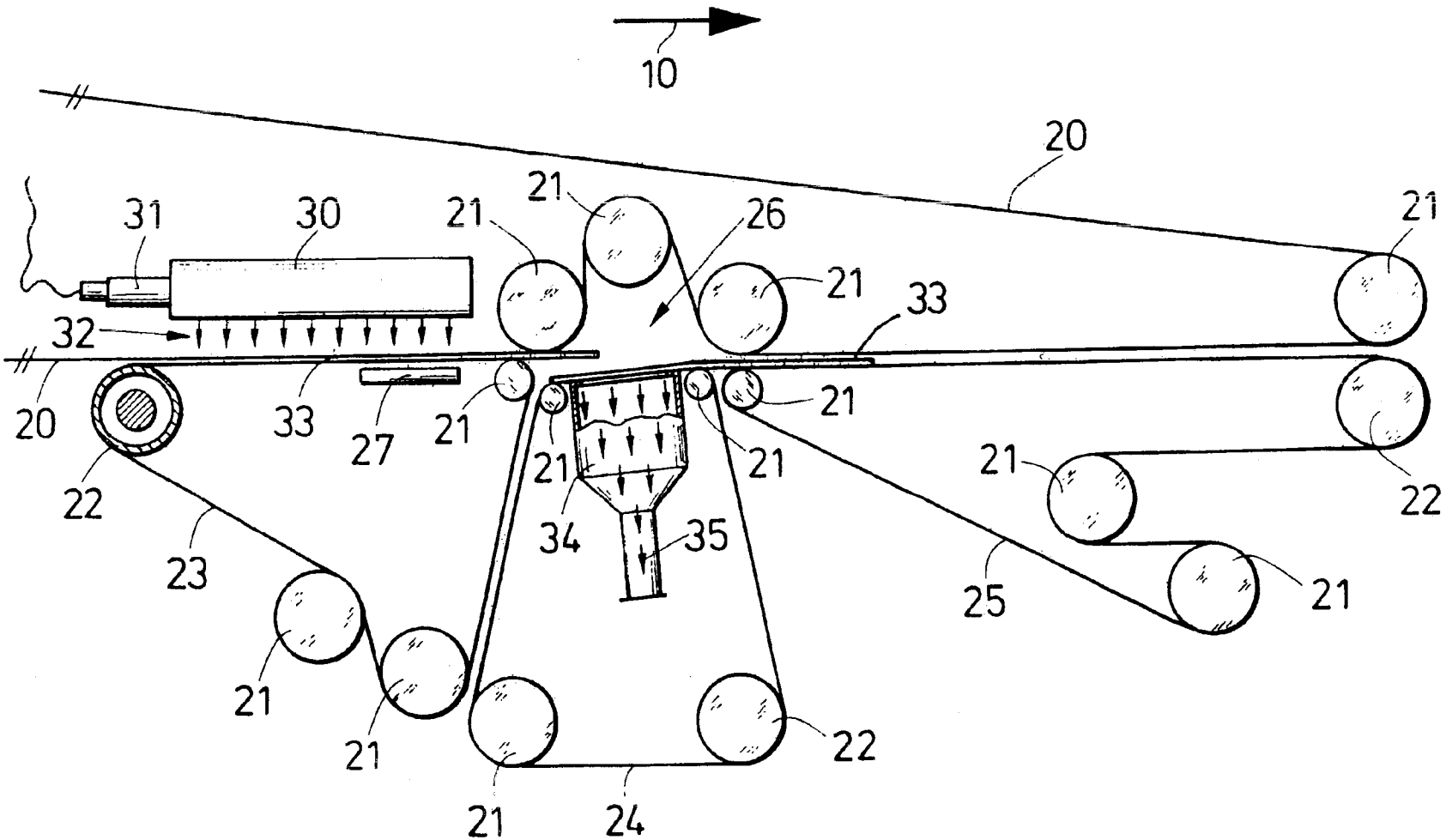
FIG. 1 is a schematic representation showing a view from the side of an essential portion of the conveying arrangement according to the invention.

FIG. 1 shows a view from the side of the essential parts of a conveying arrangement according to the invention.

Paper quires 33, held between a top belt 20 and a conveying belt 23, are transported in a conveying direction 10 toward a deceleration belt 24. The top belt 20 is deflected with deflection rollers 21 and is driven by means of a drive roller or drive unit, not shown in FIG. 1. The conveying belt 23 is deflected in the same way via deflection rollers 21 and is driven via a drive roller 22. The same is true for the deceleration belt 24 and a lower belt 25.

The paper quires consisting of several paper sheets, for example 4 to 7 sheets, are electrically charged by an ionization device 30 provided with an electrical connection 31 and the electrostatic field 32 generated with it. The paper sheets in the respective paper quire 33 are held together in this way. A preferably electrically conducting backplate electrode 27 is advantageously provided for intensifying the electrostatic field or for focusing a respective field. A corresponding ionization device, for example an electrically conductive rod that can be connected to a Van-der-Graf generator or another commercially available high-voltage source, is disclosed, for example, in German Patent No. 2 100 980.

The correspondingly charged paper quires 33 are then conveyed to the overlap region 26 where they are pulled down in the back with suction air, i.e. the left region in FIG. 1, and are thus moved to the area of intervention for the deceleration belt 24. A suction box 34, shown divided in FIG. 1, is provided for this embodiment and allows suction air 35 to act upon the paper quires 33.

A deceleration belt or conveying belt 24 that is hollow on the inside can also be provided in place of the suction box shown in FIG. 1, wherein the hollow space can be admitted with a vacuum or the gas can be suctioned out of the hollow space. Other types of suctioning devices are conceivable as well.

Several paper quires 33 are thus overlapped in the overlap region 26 and are conveyed further while overlapped between the top belt 20 and the lower belt 25 in the conveying direction to the right. There, they are subsequently stopped carefully and slowly by a frontal end stop, not shown herein, so that respective sheet stacks can be created. The speed of the deceleration belt 24 in this case corresponds approximately to the speed of the lower belt 25.

Figure 2:
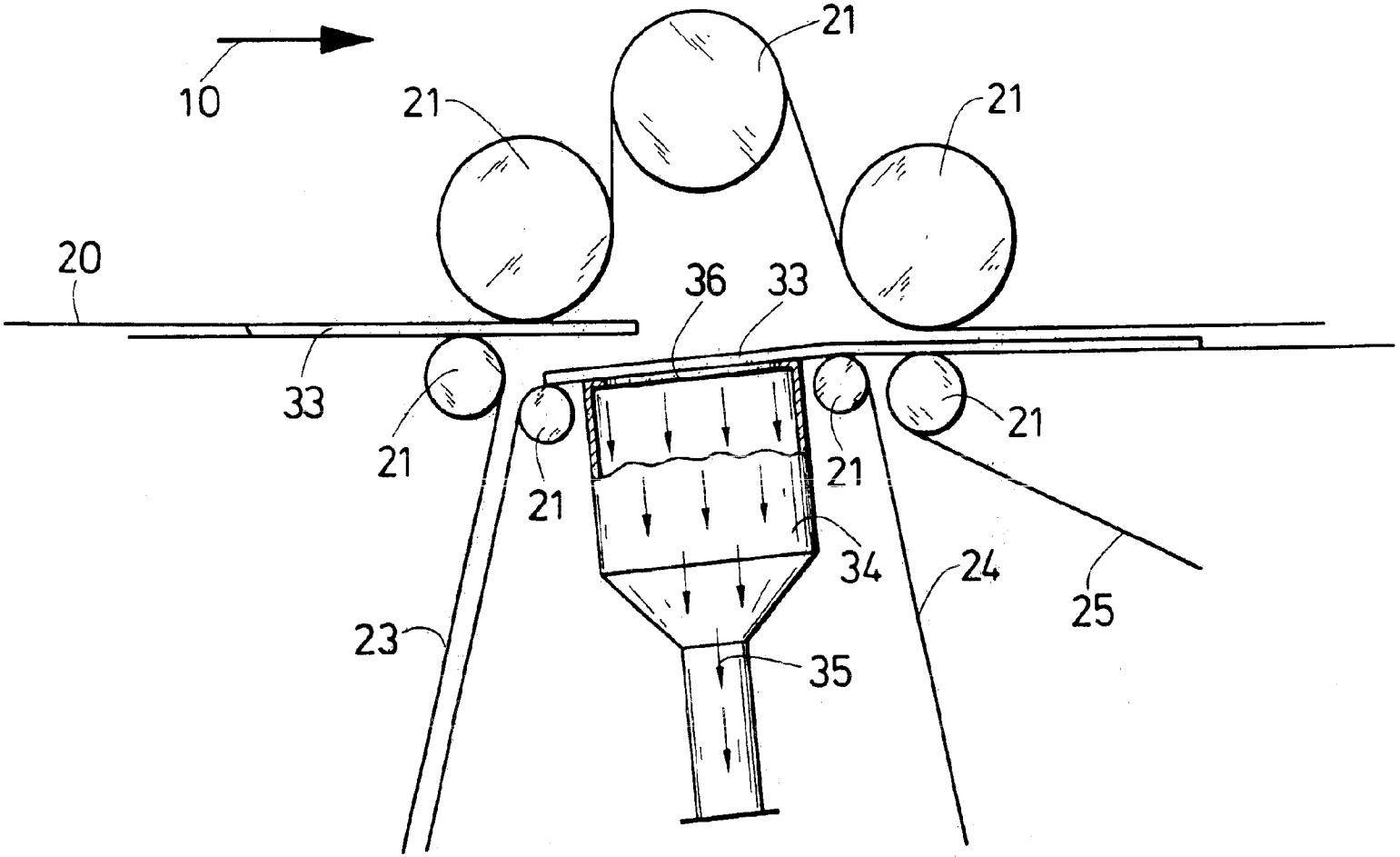
FIG. 2 shows a detailed view of the overlap region for the conveying arrangement shown in FIG. 1.

A portion of FIG. 1 is shown in further detail in FIG. 2, which contains a clearer view of a suction slot 36 of the suction box 34.

Figure 3:
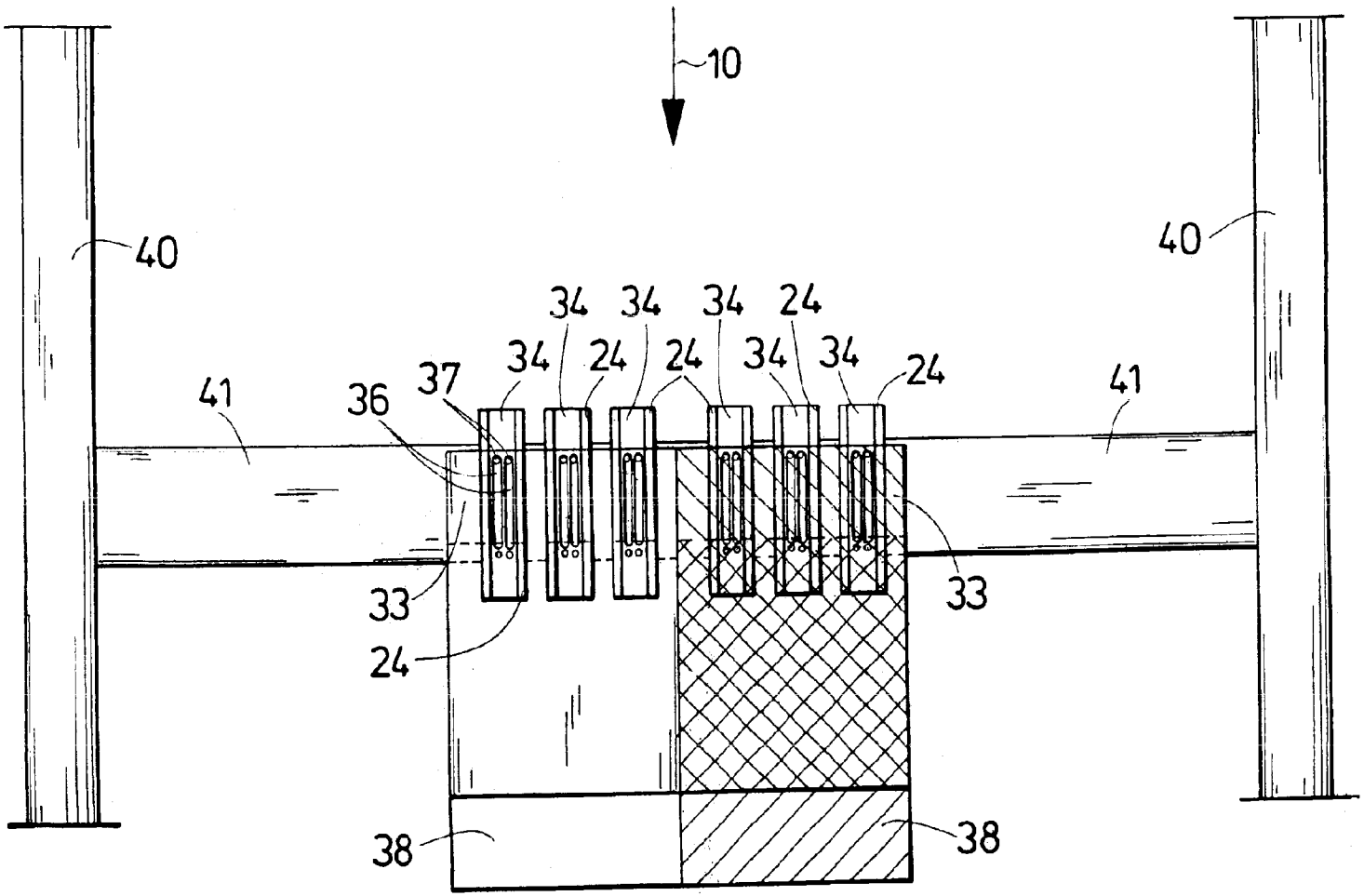
FIG. 3 is a schematic representation of a view from the top, showing a portion of the conveying arrangement in FIG. 1.

FIG. 3 provides a schematic view from the top of a portion of the conveying arrangement in FIG. 1. A machine frame 40 and a carrier 41 are shown, wherein three suction boxes 34 are provided side-by-side above the carrier 41 for each of the side-by-side guided flows of paper quires 33. In particular, the suction slots 36 and the suction holes 37 are shown. A lower paper quire 38 schematically on the right side of the two paper quire flows is shown in FIG. 3 with the reference 38 and cross hatch lines extending from the bottom left to the top right. An upper paper quire 33 is also shown with cross hatch lines extending from the top left to the bottom right. These lines are drawn only for reasons of clarity. A central area of overlap is apparent from the crisscross region of the lines. It is obvious that the suction holes 37, which are at the top in FIG. 3, are positioned in the region of the suction slots 36 and suction air acts upon the paper quire 33 at the top. The suction holes 37 shown at the bottom in FIG. 3 are located outside of the region of suction slots 36, so that suction air no longer flows through these holes. As a result, the lower paper quire 38 is no longer held in place by suction air, but only by the force of the weight itself. The deceleration or brake belts 24 are only indicated in FIG. 3. These must be envisioned as being further expanded toward the top and bottom in FIG. 3 as well as in FIG. 4, wherein corresponding suction holes 37 are provided, preferably with uniform spacing.

Figure 4:
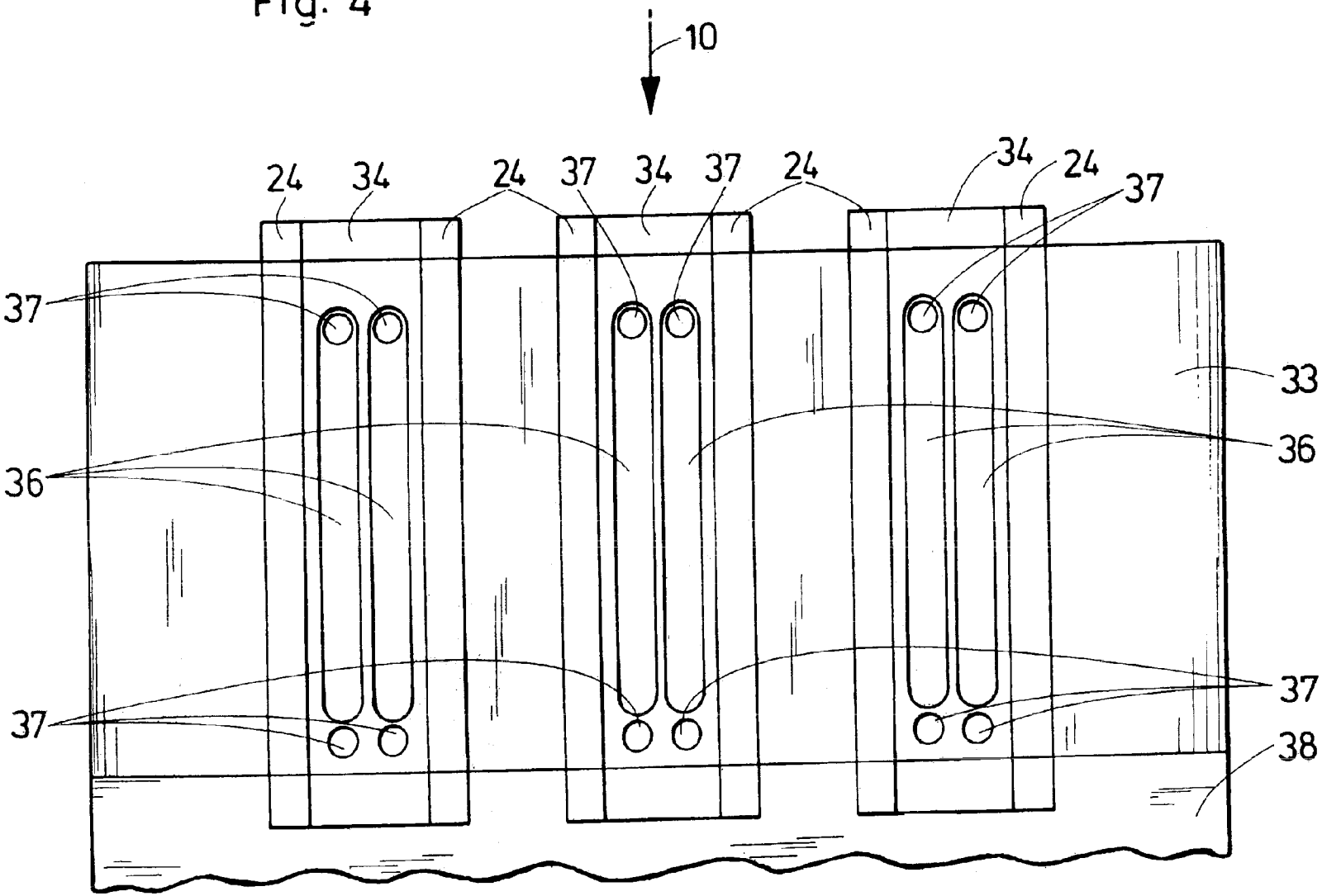
FIG. 4 shows a detail of the view shown in FIG. 3.

A section of FIG. 3 is shown in further detail in FIG. 4. The thin lines in FIG. 4 are located below objects positioned above them. Thus, a lower paper quire 38 and an upper paper quire 33 are shown, for example, wherein the upper paper quire 33 was interrupted in the lower region of FIG. 4. Furthermore, the deceleration belts 24 as well as the suction boxes 34 are located below the paper quires 33 and 38. The suction box 34 with suction slots 36 is located below the deceleration belt 24 that contains the suction holes 37. FIG. 4 additionally shows the conveying direction 10 for paper quires 33 and 38.

The following exemplary embodiment is designed to illustrate the operational method for combining the sheet quires or paper quires. A paper quire 33 is initially charged electrostatically with the ionization device 30 and, if necessary, the backplate electrode 27, such that the paper quires or the sheets in the paper quires cling together. During the continued transport of the charged paper quires to an overlap region 26, the paper quires 33 are made to overlap by admitting the rear section of the paper quire 33 that is conveyed at that instant to the overlap region with suction air. For this, the respective suction holes 37 of the deceleration belts 24 are moved to the operative range of suction box 34, meaning above the respective suction slots 36, at the instant when the back region of quire 33 enters the overlap region.

During the continued transport, the paper quire 33 is held in place by the suction air as long as the suction holes 37 still cooperate with the suction slot 36. As soon as the suction holes are outside of the region for the suction slots, suction air can no longer flow through the suction openings, so that the paper quires 33 are no longer attracted by the suction air. During the further conveying of the paper quires, the paper quires are pushed together at a frontal end stop, not shown in the figures, to form paper stacks.

With a faster conveying speed, the momentum of the paper quires 33 increases accordingly. In order to reach a sufficient fixation with the aid of suction air, it makes sense to provide for a phase displacement between the deceleration belt 24 and the top belt 20. The faster the speed, the earlier the suction air should act upon the paper quires in order to compensate for the increase in the momentum.

Figure 5:
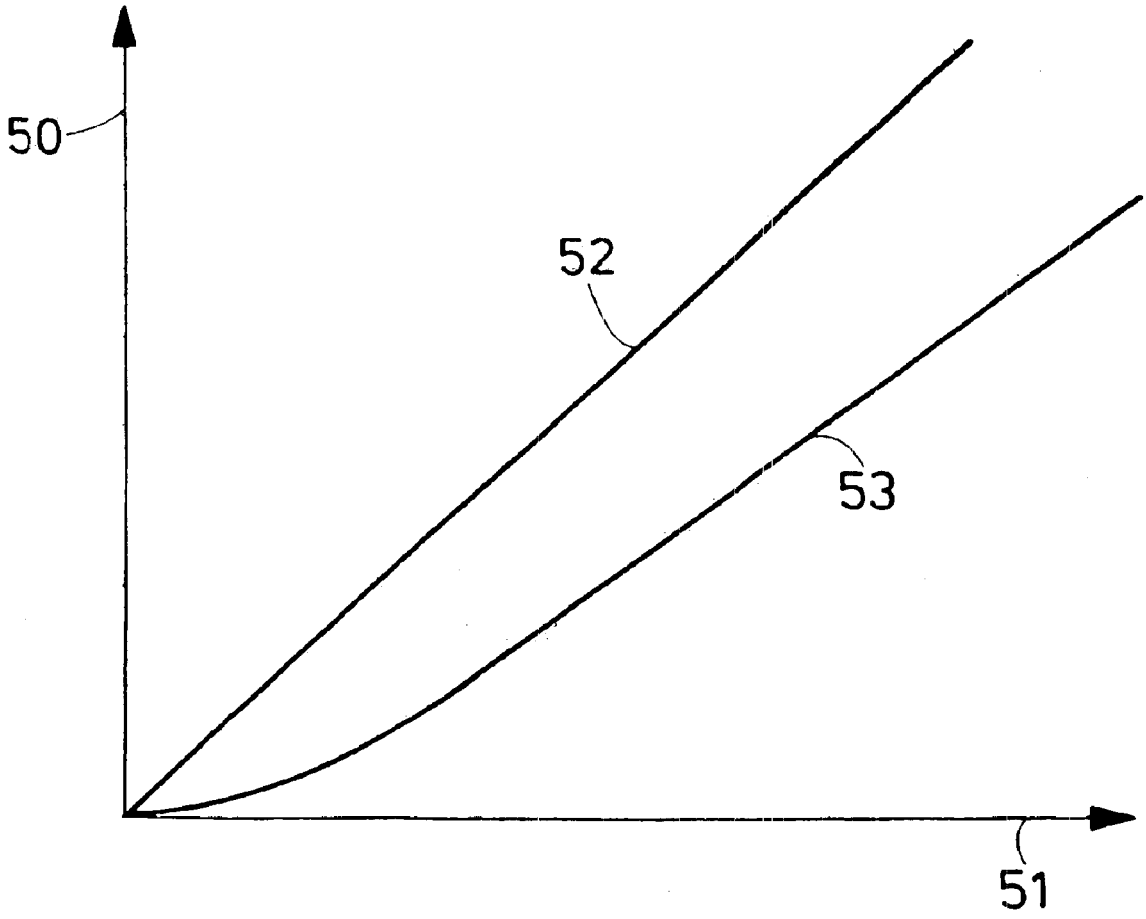
FIG. 5 shows a diagram of the phase displacement as a function of machine speed.

FIG. 5 contains a diagram illustrating two functions of the phase displacement 50 in dependence on the machine speed 51. A linear function is shown with 52 and an additional function with 53. These functions represent an exponential or quadratic increase, for example, for machine speeds that are too low and a linear course for higher machine speeds. Different function curves may be advantageous, depending on the design of the corresponding equipment parts, such as the size of the suction openings, the size of the paper quires, the vertical distance between the top belt 20 and the deceleration belt 24, the roughness of the paper and/or the suction capacity of the suction boxes or the number of suction boxes. For example, the additional curve 53 is preferred with a correspondingly very high suction capacity or a high adherence of the paper quires 33 to the deceleration belt 24.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A conveying arrangement for sheet quires, comprising:

at least two successively arranged conveying devices of which a downstream conveying device as seen in a conveying direction has a lower speed than an upstream conveying device; and at least one ionization device for electrostatic charging of the sheet quires;

wherein an area of the downstream conveying device includes a suction device for administering suction air to the sheet quires in at least one region of the sheet quires, and wherein the suction device includes stationary suction openings.

2. The conveying arrangement according to claim 1, wherein the at least one region of the sheet quires is positioned in a back region of the sheet quires as seen in the conveying direction.

3. The conveying arrangement according to claim 1, wherein the downstream conveying device includes suction openings.

4. The conveying arrangement according to claim 3, wherein the downstream conveying device includes at least one conveying belt and the suction openings extend through the at least one conveying belt of the downstream conveying device.

5. The conveying arrangement according to claim 4, wherein the suction device comprises at least one suction box with suction slots which cooperate with the suction openings.

6. The conveying arrangement according to claim 4, wherein the suction openings are arranged at a predetermined distance to each other on the at least one conveying belt.

7. The conveying arrangement according to claim 6, wherein the predetermined distance is uniform.

8. A conveying arrangement according to claim 1, wherein the conveying device is in part electrically conductive in a region of the ionization device.

9. The conveying arrangement according to claim 1, further comprising at least one additional element that is at least in part electrically conductive in a region of the ionization device.

10. The conveying arrangement according to claim 1, wherein the at least two successively arranged conveying devices have a phase displacement between them which depends on the speed of the conveying arrangement.

11. The conveying arrangement according to claim 10, wherein a linear connection exists between the phase displacement and the speed of the conveying arrangement.

12. The conveying arrangement according to claim 10, wherein the higher the speed of the conveying arrangement, the more the phase of the downstream conveying device precedes the phase of the upstream conveying device.

13. A paper-processing machine including at least one conveying arrangement according to claim 1.

* * * * *